US007947133B2

(12) United States Patent
Mihara et al.

(10) Patent No.: US 7,947,133 B2
(45) Date of Patent: May 24, 2011

(54) COPPER ALLOY STRIP MATERIAL FOR ELECTRICAL/ELECTRONIC EQUIPMENT AND PROCESS FOR PRODUCING THE SAME

(75) Inventors: Kuniteru Mihara, Tokyo (JP); Tatsuhiko Eguchi, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 253 days.

(21) Appl. No.: 12/310,910

(22) PCT Filed: Sep. 12, 2007

(86) PCT No.: PCT/JP2007/067730

§ 371 (c)(1),
(2), (4) Date: Mar. 12, 2009

(87) PCT Pub. No.: WO2008/032738

PCT Pub. Date: Mar. 20, 2008

(65) Prior Publication Data

US 2009/0257909 A1 Oct. 15, 2009

(30) Foreign Application Priority Data

Sep. 12, 2006 (JP) ..... 2006-246961
Sep. 11, 2007 (JP) ..... 2007-236003

(51) Int. Cl.
*C22C 9/06* (2006.01)
*C22F 1/08* (2006.01)

(52) U.S. Cl. ..... 148/435; 148/554; 420/485; 420/486; 420/487; 420/488

(58) Field of Classification Search ..... 148/554, 148/435; 420/485, 486, 487, 488
See application file for complete search history.

(56) References Cited

U.S. PATENT DOCUMENTS 6,093,499 A * 7/2000 Tomioka ..... 428/606
6,132,529 A * 10/2000 Hatakeyama et al. ..... 148/435
6,165,246 A * 12/2000 Kira et al. ..... 75/247
6,334,915 B1 * 1/2002 Ogura et al. ..... 148/435
6,436,206 B1 * 8/2002 Bhargava ..... 148/554

FOREIGN PATENT DOCUMENTS

JP 05-279825 A 10/1993
JP 6-184680 A 7/1994
JP 8-325681 A 12/1996

(Continued)

OTHER PUBLICATIONS

Office Action of Chinese Patent Office, Mar. 10, 2010, Application No. 2007800412673.

*Primary Examiner* — Sikyin Ip
(74) *Attorney, Agent, or Firm* — Kubotera & Associates LLC

(57) ABSTRACT

A copper alloy strip material for electrical/electronic equipment includes a copper alloy containing 2.0 to 5.0 mass % Ni, 0.43 to 1.5 mass % Si, and a remaining component formed of Cu and an unavoidable impurity. Three types of intermetallic compounds A, B, and C comprising Ni and Si in a total amount of 50 mass % or more are contained. The intermetallic compound A has a compound diameter of 0.3 μm to 2 μm, the intermetallic compound B has a compound diameter of 0.05 μm to less than 0.3 μm, and the intermetallic compound C has a compound diameter of more than 0.001 μm to less than 0.05 μm.

4 Claims, 2 Drawing Sheets

FOREIGN PATENT DOCUMENTS

| | | | |
|---|---|---|---|
| JP | 10-219374 | * | 8/1998 |
| JP | 10-219374 A | | 8/1998 |
| JP | 10-265874 A | | 10/1998 |
| JP | 2001-049369 | | 2/2001 |
| JP | 2005-48262 A | | 2/2005 |
| JP | 2005-298920 | | 10/2005 |
| JP | 2005-307223 | * | 11/2005 |
| JP | 2005-307223 A | | 11/2005 |
| JP | 2006-233314 A | | 9/2006 |

* cited by examiner

COPPER ALLOY STRIP MATERIAL FOR ELECTRICAL/ELECTRONIC EQUIPMENT AND PROCESS FOR PRODUCING THE SAME

TECHNICAL FIELD

The present invention relates to a Cu—Ni—Si-based copper alloy strip material suitable for electrical/electronic equipment.

BACKGROUND ART

Conventionally, Fe-based materials are used for electrical/electronic equipment, and recently Cu-based materials having excellent electricity and heat conductivity such as phosphor bronze, tombac, brass, Corson alloy, and the like have been widely used. As electrical/electronic equipment have become smaller, lighter in weight, and been more densely integrated in recent years, the Cu-based materials for electrical/electronic equipment need to improve strength, conductivity, stress relaxation resistance property, bending workability, plating property, press formability, heat resistance, and the like.

The Corson alloy, in which Ni and Si are added to Cu to precipitate a Ni—Si-based compound, is a Cu—Ni—Si-based alloy having excellent strength. For example, CDA70250 alloy registered on CDA (Copper Development Association) is commercially available.

Another Cu—Ni—Si-based alloy, in which a distribution state of a Ni—Si-based compound is designed to improve properties thereof, has been proposed (refer to Japanese Patent Publication Laid-Open Nos. 2005-298920 and 2001-49369).

However, the CDA70250 alloy and the Corson alloys disclosed in Japanese Patent Publication Laid-Open Nos. 2005-298920 and 2001-49369 fail to fully satisfy properties required for electrical/electronic equipment, and especially, do not provide sufficient plating property, press formability, and heat resistance.

DISCLOSURE OF THE INVENTION

In view of the above-mentioned problems, an object of the present invention is to provide a copper alloy strip material for electrical/electronic equipment such as lead frames, connectors, terminals, relays, switches, and the like, capable of exhibiting excellent plating property, press formability, and heat resistance, and a process for producing the copper alloy strip material.

The present inventors have studied a copper alloy strip material for electrical/electronic equipment to evaluate a relationship between a particle diameter (diameter of a compound grain) of a compound dispersed in the copper alloy strip material and a dispersion density, and properties thereof such as plating property, press formability, and heat resistance. As a result, it was found that the properties are improved through optimizing the grain diameter and the dispersion density, and based upon on the knowledge, the present invention has been accomplished.

To achieve the above objects, according to an aspect (1) of the present invention, a copper alloy strip material for electrical/electronic equipment comprises: a copper alloy containing 2.0 to 5.0 mass % Ni, 0.43 to 1.5 mass % Si, and a remaining component formed of Cu and an unavoidable impurity. Three types of intermetallic compounds A, B, and C comprising Ni and Si in a total amount of 50 mass % or more are contained, said intermetallic compound A having a compound diameter of 0.3 μm to 2 μm (an arithmetic mean between a minimum value and a maximum value of the compound diameter, and hereinafter, defined as the same), said intermetallic compound B having a compound diameter of 0.05 μm to less than 0.3 μm, said intermetallic compound C having a compound diameter of more than 0.001 μm to less than 0.05 μm.

According to an aspect (2) of the present invention, in the copper alloy strip material for electrical/electronic equipment in the aspect (1), the intermetallic compound A has a dispersion density a, the intermetallic compound B has a dispersion density b, and the intermetallic compound C has a dispersion density c, so that an expression $[a/(b+c) \leqq 0.010]$ is satisfied.

According to an aspect (3) of the present invention, in the copper alloy strip material for electrical/electronic equipment in one of the aspects (1) and (2), the intermetallic compound B has a dispersion density b and the intermetallic compound C has a dispersion density c, so that an expression $[0.001 \leqq (b/c) \leqq 0.10]$ is satisfied.

According to an aspect (4) of the present invention, the copper alloy strip material for electrical/electronic equipment in one of the aspects (1) to (3) further includes a crystal grain having a sectional shape taken along a plane perpendicular to a rolling direction thereof. The sectional shape has a horizontal length X (μm) and a vertical length y (μm), so that an expression $[x/y \geqq 2]$ is satisfied.

According to an aspect (5) of the present invention, the copper alloy strip material for electrical/electronic equipment in one of the aspects (1) to (4) further comprises at least one selected from the group consisting of Al, As, Hf, Zr, Cr, Ti, C, Co, Fe, P, In, Sb, Mn, Ta, V, Sn, Zn, and Mg in a total amount of 0.005 to 1.5 mass %.

According to an aspect (6) of the present invention, a method for producing a copper alloy strip material for electrical/electronic equipment includes the steps of: reheating a cast ingot of a copper alloy comprising 2.0 to 5.0 mass % Ni, 0.43 to 1.5 mass % Si, and a remaining component formed of Cu and an unavoidable impurity at a temperature in a range between 850° C. and 950° C. for two hours to ten hours; hot rolling the cast ingot of the copper alloy for 100 seconds to 500 seconds to obtain a copper alloy strip material; rapidly cooling the copper alloy strip material to a temperature in a range between 600° C. and 800° C.; and performing an aging heat treatment on the copper alloy strip material at a temperature in a range between 400° C. and 550° C. for one hour to four hours.

According to an aspect (7) of the present invention, in the method of producing a copper alloy strip material for electrical/electronic equipment in the aspect (6), the cast ingot of the copper alloy further contains at least one selected from the group consisting of Al, As, Hf, Zr, Cr, Ti, C, Co, Fe, P, In, Sb, Mn, Ta, V, Sn, Zn, and Mg in a total amount of 0.005 to 1.5 mass %.

Another characteristics and advantages of the present invention will be more apparent from the following description with reference to the drawings.

BRIEF DESCRIPTION OF THE DRAWINGS

FIGS. 1*a* to 1*c* are photographs of a transmission electronic microscope showing a copper alloy at an accelerating voltage of 300 kV, wherein FIGS. 1*a* and 1*b* are photographs at a magnification of 50,000, and FIG. 1*c* is a photograph at a magnification of 100,000.

BEST MODE OF THE INVENTION

Figure 1:
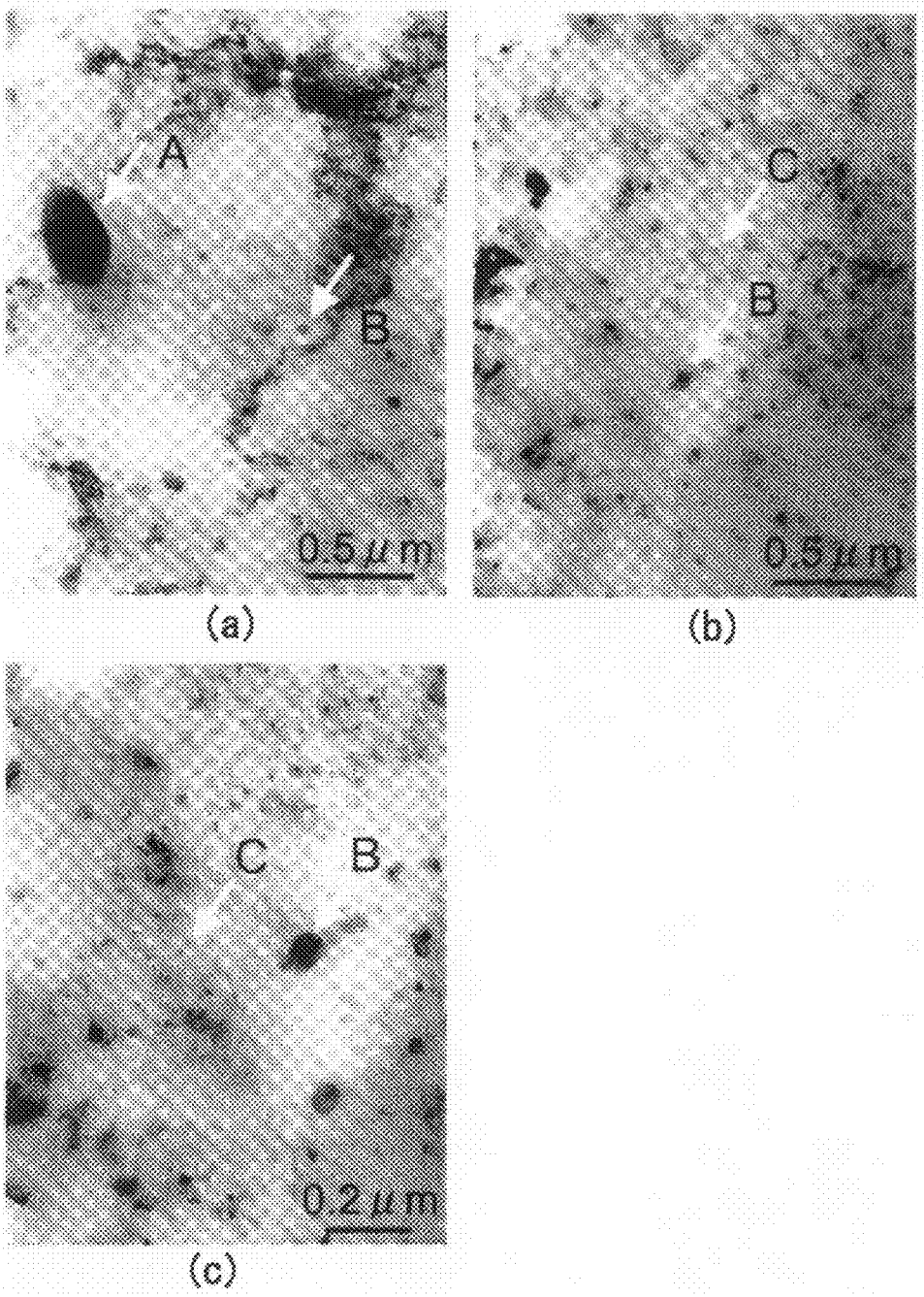

A copper alloy strip material suitable for electrical/electronic equipment according to preferred embodiments of the present invention will be explained in detail. First, a copper alloy composition in the copper alloy strip material of the present invention will be described with reference to operating effects of respective alloy elements and their content.

Ni and Si form precipitates of a Ni—Si compound, thereby improving strength.

A content of Ni is in a range from 2.0 to 5.0 mass %, preferably from 2.5 to 3.5 mass %, and a content of Si is in a range from 0.43 to 1.5 mass %, preferably from 0.5 to 0.7 mass %, more preferably from 0.8 to 1.1 mass %.

The contents of Ni and Si are defined since when the contents are less than a lower limit, a sufficient strength is not obtained. Contrarily, when the contents are more than an upper limit, conductivity lowers while the strength is saturated.

A mass ratio of Ni and Si is not specially restricted, and it is preferable that Si is in a range of 0.2 to 0.3 with respect to 1 of Ni. The upper limit of the content of Si is defined since when the content of Si is ¼ of the content of Ni, the strength becomes highest, and when the content of Si is more than 1.5 mass %, hot rolling cracks are easily happened.

According to the present invention, preferably, the copper alloy strip material further includes at least one element selected from the group consisting of Al, As, Hf, Zr, Cr, Ti, C, Co, Fe, P, In, Sb, Mn, Ta, V, Sn, Zn and Mg, thereby improving the strength. A total content of the elements is 0.005 to 1.5 mass %, preferably 0.01 to 1.0 mass %. When the content is less than 0.005 mass %, the effect cannot be sufficiently obtained, and contrarily, when the content is more than 1.5 mass %, the conductivity becomes decreased.

According to the present invention, a fine Ni—Si-based intermetallic compound is produced in a parent phase of a copper base, so that the strength of the alloy is increased, and the electrical conductivity is improved. In the present invention, a size of the compound is adjusted. More specifically, an arithmetic mean of a minimum value and a maximum value of a diameter of the compound is defined as a diameter of the compound. Based on the diameter of the compound, the compound is classified into compounds A, B and C. According to the present invention, at least the compounds B and C are contained in the copper alloy strip material.

In measuring the diameter of the compound (compound diameter), a circular plate having a diameter of 3 mm is punched out from an alloy sample, and is polished through twin-jet polishing to obtain a thin film. Next, photographs of the alloy sample are taken at arbitrary three positions thereof at magnifications of 50,000 and 100,000 using a transmission electronic microscope at an accelerating voltage of 300 kV, such that the diameters and the number of compounds are measured on the photographs. Accordingly, the compounds A, B and C are defined according to the diameters of the compounds (the arithmetic mean of the minimum value and the maximum value of the diameters of the compounds).

FIG. 1 is a measured result of No. 9 in the example 2 of the present invention using the transmission electronic microscope at an accelerating voltage of 300 kV, wherein FIGS. 1*a* and 1*b* are photographs at the magnification of 50,000 and FIG. 1*c* is a photograph at the magnification of 100,000. A dispersion density of the compounds A, B and C is obtained by the following manner.

(1) The compounds in the photographs taken at the arbitrary three positions are classified by sizes thereof. In this case, the diameter of the compound is the arithmetic mean of the minimum value and the maximum value of the diameters of the compound.

(2) The number of the compounds is counted according to the sizes thereof, and the counted number is divided by an area of each photograph and is continuously converted into unit area ($mm^2$).

(3) The above process is conducted for the three photographs at the magnifications of 50,000 and 100,000, respectively, thereby obtaining the average value of the total six photographs.

The compound A has a total of more than 50 mass % of Ni and Si and the diameter in a range from 0.3 μm to 2 μm, while exhibiting a relatively low contribution to an improvement of a tensile strength of the copper alloy strip material as compared with the compounds B and C. When the compound A is contained in an excessive amount in the copper alloy strip material, it may decrease the plating property of the copper alloy strip material. Furthermore, when the content of the compound A is increased, the contents of the compounds B and C contributing to the improvement of the properties of the copper alloy strip material are decreased. It is therefore preferable that the content of the compound A should be small. A dispersion density a of the compound A is preferably less than 10 number/$mm^2$.

According to the present invention, the compound A is produced during the melting/casting, the solidification process, or the non-equilibrium heat treatment during hot working, and the compound A easily disappears or decreases in a size when the reheating treatment before the hot rolling or the solution heat treatment (homogenizing treatment) after the hot rolling is conducted at a high temperature or for a long period of time. The reheating treatment is conducted under conditions of a temperature of more than 900° C. for 0.5 hour or greater in the industrial field thereof, but in the conditions, the compound A may remain or be produced during the hot rolling.

According to the present invention, the compound B has a total of more than 50 mass % of Ni and Si and the diameter in a range from 0.05 μm to less than 0.3 μm, thereby improving press formability. That is, when the copper-based parent phase of the copper alloy strip material is deformed in a state of being sandwiched between a punch and a die during the press working, the compound is deformed because of high hardness, so that fine cracks occur on the copper-based parent phase around the compound. Accordingly, the cracks tend to propagate, thereby making the shearing working easy and improving the press formability. The effect cannot be sufficiently obtained when the diameter of the compound is less than 0.05 μm or more than 0.3 μm. Even though the content of the compound B is increased, the effect of the compound B is saturated. Further, the content of the compound C contributing to the improvement of other properties in the copper alloy strip material may be reduced.

The grain diameter and dispersion density of the compound B can be controlled by adjusting the number of rolling passes during the hot rolling, an interval time of the rolling passes, the hot rolling finish temperature, and the time required until the water quenching after the completion of the rolling. A dispersion density b of the compound B is preferably in a range from $10^2$ number/$mm^2$ to $10^6$ number/$mm^2$.

According to the present invention, the compound C has a total of more than 50 mass % of Ni and Si and the diameter more than 0.001 μm and less than 0.05 μm, thereby contributing to the improvement of the heat resistance. A lead frame is subjected to the stress relief annealing after the press working so as to remove a residual stress generated during the press working. A material having high heat resistance is preferable due to a relatively small change in hardness upon the stress relief annealing. When the content of the compound C is excessive, the conductivity may be decreased.

The diameter and dispersion density of the compound C are controlled by adjusting conditions (temperature and time) of the heat treatment. When the temperature of the heat treatment is high and the time of the heat treatment is long, the grain diameter of the compound becomes large and the conductivity becomes high, but the tensile strength becomes low. On the other hand, when the temperature of the heat treatment is low, the grain diameter of the compound becomes small and the conductivity becomes low. A dispersion density c of the compound C is preferably in a range from $10^4$ number/mm$^2$ to $10^9$ number/mm$^2$, more preferably in a range from $10^5$ number/mm$^2$ to $10^7$ number/mm$^2$.

According to the present invention, when the dispersion density a of the compound A, the dispersion density b of the compound B, and the dispersion density c of the compound C satisfy an expression [$a/(b+c) \leqq 0.010$], it is possible to improve the press formability and strength. When a/(b+c) is more than 0.010, the press formability and strength are decreased and further the plating property is decreased.

According to the present invention, when the dispersion density b of the compound B and the dispersion density c of the compound C satisfy an expression [$0.001 \leqq (b/c) \leqq 0.10$], it is possible to improve the press formability. When b/c is less than 0.001, the press formability is not sufficiently obtained, and when b/c is more than 0.10, the precipitation strengthening is low so that the strength is not sufficiently obtained.

According to the present invention, when the compounds A, B and C have a total of more than 50 mass % of Ni and Si, the effect of the present invention can be achieved. It is preferable that they have a total of more than 75 mass % of Ni and Si. In addition to Ni and Si, Cu or other elements may be contained.

According to the present invention, the compositions of the compounds A, B and C can be appropriately analyzed using an energy dispersive spectroscopy (EDS) attached on the transmission electronic microscope. At this time, because of an influence of the copper-based parent phase, a peak value of copper and a background are removed from a obtained chart, and peak values of Ni, Si and other elements are standardized to calculated values, thereby obtaining percentages of Ni and Si contained in the compounds.

The copper alloy strip material containing the compounds A, B and C having the dispersion densities satisfying the above expressions can be manufactured by, for example, the following process.

The cast ingot of the copper alloy comprising 2.0 mass % to 5.0 mass % Ni and 0.43 mass % to 1.5 mass % Si is reheated to a temperature range from 850° C. to 950° C. for two hours to ten hours. In the next step, the hot rolling is conducted for 100 seconds to 500 seconds. The hot rolling finish temperature is in a range between 600° C. and 800° C. and the cooling is rapidly conducted. The rapid cooling conditions preferably include a cooling speed in a range between 5° C./sec and 100° C./sec and a temperature more than 300° C. After that, the cold rolling and annealing are repeatedly conducted if necessary. Afterward, the aging heat treatment is conducted in the conditions of the temperature between 400° C. and 550° C. for one hour to four hours. As a result, the copper alloy strip material having excellent plating property, press formability, and heat resistance is produced.

It is preferable that the reheating conditions include the temperature between 875° C. and 925° C. and the time of four hours to six hours; the hot rolling time is 400 seconds to 600 seconds; the hot rolling finish temperature is between 650° C. and 750° C.; the rapid cooling speed is in a range between 20° C./sec and 50° C./sec (in a temperature range of more than 300° C.); and the aging heat treatment conditions include the temperature between 425° C. and 500° C. and the time of 1.5 hours to 3.5 hours.

Figure 2:
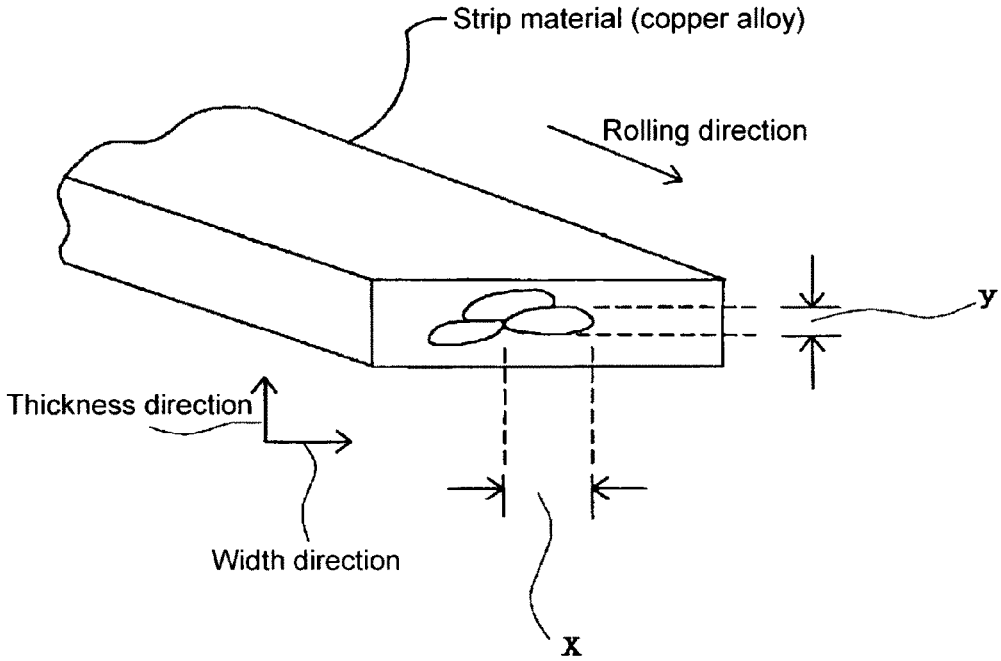
FIG. 2 is a perspective view showing a crystal grain diameter of a copper alloy strip material.

According to the present invention, when it is designed such that the grain diameter has a section taken along a plane perpendicular to the rolling direction of the copper alloy strip material and having a ratio [x/y] of a horizontal length x (μm) to a vertical length y (μm) more than 2, the press formability is improved. It is preferable that the ratio [x/y] is more than 4. As shown in FIG. 2, the horizontal length x is parallel to a width direction of the plate, and the vertical length y is parallel to the thickness direction of the plate. The ratio [x/y] is controllable through the hot rolling conditions.

According to the present invention, in the copper alloy strip material, the diameters (compound diameters) of the intermetallic compounds (hereinafter, referred simply to as compounds) contained in the Cu—Ni—Si-based copper alloy strip material are appropriately prescribed. Accordingly, it is possible to improve the plating property, press formability and heat resistance suitable for electrical/electronic equipment. In addition, the dispersion densities of the grain diameters of the compounds and the crystal grain diameter of the copper-based parent phase are optimized, thereby improving the above-mentioned properties. Further, the copper alloy strip material may include at least one element selected from the group consisting of Al, As, Hf, Zr, Cr, Ti, C, Co, Fe, P, In, Sb, Mn, Ta, V, Sn, Zn and Mg in a total amount of 0.005 to 1.5 mass %, thereby improving the strength.

According to the present invention, the copper alloy strip material can be easily manufactured by adjusting the reheating conditions before the hot rolling process, the hot rolling conditions, and the aging heat treatment conditions.

EXAMPLES

The present invention will be in more detail described below with reference to examples. The present invention is not limited to the following examples.

Example 1

Copper alloys (No. 1 to No. 6) having compositions listed in Table 1 comprising 2.0 to 5.0 mass % Ni, 0.43 to 1.08 mass % Si and a remaining component formed of Cu and unavoidable impurities were molten using a high frequency molting furnace and were cast at a cooling speed between 10° C./sec and 30° C./sec, thereby obtaining cast ingots having a thickness of 30 mm, a width of 100 mm, and a length of 150 mm. The cast ingots were reheated under conditions shown in Table 1, and the hot rolling as shown in Table 1 was conducted to obtain hot rolled plates having a thickness of 12 mm. Next, face milling was conducted on the plates by 1 mm in both surfaces thereof, thereby obtaining plates having a thickness of 10 mm. Next, the cold rolling was conducted on the plates to obtain cold rolled plates having a thickness of 0.167 mm. After that, the solid heat treatment was conducted at a temperature of 950° C. for 20 seconds, and then, the plates were immediately quenched in water. Next, the aging heat treatment was carried out as shown in Table 1, and finish cold rolling was conducted at a rolling reduction ratio of 10%, thereby obtaining respective test materials. Next, properties for the produced test materials were investigated.

The properties for the produced test materials were determined by the following methods.

(a) Conductivity

Specific resistance for each test material was obtained through four-point probe measurement in a thermostat where water was maintained at a temperature of 20° C. (in a range between 19.5° C. and 20.5° C.), thereby calculating conductivity. A distance between the probe points was 100 mm.

(b) Tensile Strength

Three test pieces were cut from each test material in a direction in parallel to the rolling direction thereof according to JIS Z2201-5, and the tensile strength test was conducted on the test pieces in compliance with JIS Z2241, thereby obtaining an average value of the test pieces.

(c) Heat Resistance

The plate material taken from each test material was heated in inert gas at temperatures every 50° C. from 400° C. to 700° C. for 30 minutes, thereby measuring surface hardness using a Vickers hardness tester. The surface hardness was measured at five positions and an average value thereof was obtained. A half-softening temperature was defined as a temperature showing a middle value between hardness of a non-heat treated material (as material) and lowest hardness. When the half-softening temperature was more than 500° C., a result is represented as A, when in a range between 450° C. and 500° C., a result is represented as B, and when less than 450° C., a result is represented as C. The material having high heat resistance desirably exhibits excellent stability in the stress relief annealing after the press working.

(d) Press Formability

The test materials were cut with a simple press machine having a clearance of 10% between a punch and a die thereof, and a cut portion was filled in a resin and was subjected to mechanical and wet polishing. After that, a cut surface was observed using an optical microscope at a magnification of 400, thereby measuring a length of a burr. The lengths were measured at five locations in a direction in parallel to the rolling direction and in a direction perpendicular to the rolling direction, respectively, thereby obtaining an average value thereof (n=10).

When the length of the bur was less than 1 μm, a result is represented as A, when in a range between 1 μm and 3 μm, a result is represented as B, and when more than 3 μm, a result is represented as C. When the burr has a shorter length, the press formability is better.

(e) Plating Property

The test materials was plated with Ag at a thickness of about 2 μm, and the plated test materials were heated at temperatures of 350° C., 400° C. and 450° C. for ten minutes. After that, expansion of an Ag plated portion was observed over a size of 30 mm×30 mm using the optical microscope at a magnification of 200. When the number of expanded portions is 0, a result is represented as A, when between 1 and 5, a result is represented B, and when more than 5, a result is represented C. When the plating expansion exists, bonding property becomes low.

Example 2

Copper alloys (No. 7 to No. 17) having compositions listed in Table 1 comprising 3.0 mass % Ni, 0.65 mass % Si, Mg or Zn having contents shown in Table 1, and the remaining component formed of Cu and unavoidable impurities were subjected to treatments similar to those of example 1 except conditions shown in Table 1, thereby obtaining test materials. The test materials were evaluated similarly to example 1.

Example 3

Copper alloys (No. 21 to No. 30) having compositions listed in Table 2 comprising 2.4 to 3.3 mass % Ni, 0.43 to 1.08 mass % Si, Mg, Zn or Sn having contents shown in Table 2, and the remaining component formed of Cu and unavoidable impurities were subjected to treatments similar to those of example 1 except conditions shown in Table 1, thereby obtaining test materials. The test materials were evaluated similarly to example 1.

Comparative Example 1

Copper alloys (No. 31 to No. 37) having compositions listed in Table 2 comprising 3.0 mass % Ni, 0.65 mass % Si, Mg or Zn having contents shown in Table 2, and the remaining component formed of Cu and unavoidable impurities were subjected to treatments similar to those of example 1 except at least one of conditions out of scope of the invention, thereby obtaining test materials. The test materials were evaluated similarly to example 1.

Results of the evaluation of example 1 and 2 are shown in Table 1, and those of example 3 and comparative example 1 are shown in Table 2. Tables 1 and 2 show the manufacturing conditions, a/(b+c), b/c, total density (mass %) of Ni and Si in compounds A, B and C, and the horizontal to vertical ratio x/y of the crystal grain.

TABLE 1

| | | Alloy element | | | Manufacturing Condition | | | | | | | |
|---|---|---|---|---|---|---|---|---|---|---|---|---|
| | | Mass % | | | Reheating | | Hot rolling | | | Aging heat treatment | | |
| | | | | | | | | End | Cooling | | | |
| Classi-fication | No | No | Si | Selected Element | Temp. ° C. | Time hr | Time Sec. | Temp ° C. | Speed ° C./Sec | Temp. ° C. | Time hr | a/(b + c) |
| Example No. 1 | 1 | 3.0 | 0.65 | — | 850 | 8 | 300 | 710 | 60 | 450 | 3 | 0.005 |
| | 2 | 3.0 | 0.65 | — | 880 | 4 | 400 | 730 | 50 | 470 | 3.5 | 0.007 |
| | 3 | 3.0 | 0.65 | — | 920 | 6 | 200 | 775 | 70 | 465 | 2.5 | 0.009 |
| | 4 | 3.0 | 0.65 | — | 950 | 5 | 300 | 750 | 90 | 430 | 4 | 0.009 |
| | 5 | 2.0 | 0.43 | — | 920 | 4 | 350 | 725 | 40 | 425 | 6 | 0.008 |
| | 6 | 5.0 | 1.08 | — | 920 | 2 | 220 | 760 | 100 | 440 | 4 | 0.003 |
| Example No. 2 | 7 | 3.0 | 0.65 | 0.1Mg | 900 | 5 | 300 | 700 | 80 | 450 | 2 | 0.008 |
| | 8 | 3.0 | 0.65 | 0.1Mg | 875 | 4 | 350 | 680 | 70 | 425 | 4 | 0.005 |
| | 9 | 3.0 | 0.65 | 0.1Mg | 850 | 5 | 180 | 780 | 120 | 500 | 1 | 0.003 |
| | 10 | 3.0 | 0.65 | 0.1Mg | 875 | 4 | 450 | 750 | 80 | 475 | 3 | 0.005 |

TABLE 1-continued

| | | | | | | | | | | | |
|---|---|---|---|---|---|---|---|---|---|---|---|
| 11 | 3.0 | 0.65 | 0.1Mg | 900 | 3 | 300 | 720 | 180 | 450 | 2 | 0.008 |
| 12 | 3.0 | 0.65 | 0.1Mg | 880 | 4 | 250 | 750 | 40 | 475 | 1.5 | 0.005 |
| 13 | 3.0 | 0.65 | 0.5Zn | 900 | 6 | 350 | 720 | 50 | 440 | 3 | 0.008 |
| 14 | 3.0 | 0.65 | 0.5Zn | 880 | 3 | 400 | 700 | 100 | 480 | 1.5 | 0.007 |
| 15 | 3.0 | 0.65 | 0.15Mg | 920 | 5 | 350 | 690 | 50 | 450 | 2 | 0.006 |
| 16 | 3.0 | 0.65 | 0.15Mg | 890 | 4 | 280 | 730 | 80 | 470 | 1.5 | 0.004 |
| 17 | 3.0 | 0.65 | 0.15Mg | 920 | 3 | 220 | 780 | 40 | 440 | 2 | 0.004 |

| | | | ① | | Characteristics | | | | |
|---|---|---|---|---|---|---|---|---|---|
| Classi-fication | No | b/c | Ni + Si in the compound | ② x/y | Plating property | Press form-ability | Heat Resis-tance | Conduc-ttivity | Tensile Strength |
| Example No. 1 | 1 | 0.008 | 85 | 2.8 | A | A | A | 52 | 689 |
| | 2 | 0.004 | 87 | 3.1 | A | A | A | 54 | 683 |
| | 3 | 0.011 | 86 | 2.9 | A | A | A | 53 | 679 |
| | 4 | 0.012 | 83 | 2.6 | A | A | A | 49 | 724 |
| | 5 | 0.004 | 81 | 2.7 | A | A | A | 50 | 712 |
| | 6 | 0.003 | 79 | 3.0 | A | A | A | 51 | 705 |
| Example No. 2 | 7 | 0.015 | 89 | 3.1 | A | A | A | 51 | 699 |
| | 8 | 0.012 | 84 | 3.1 | A | A | A | 48 | 730 |
| | 9 | 0.004 | 82 | 2.7 | A | A | A | 57 | 635 |
| | 10 | 0.013 | 83 | 2.9 | A | A | A | 54 | 667 |
| | 11 | 0.002 | 81 | 2.4 | A | A | A | 51 | 699 |
| | 12 | 0.051 | 82 | 2.8 | A | A | A | 54 | 667 |
| | 13 | 0.055 | 77 | 3.1 | A | A | A | 50 | 711 |
| | 14 | 0.004 | 79 | 3.4 | A | A | A | 55 | 660 |
| | 15 | 0.055 | 80 | 2.8 | A | A | A | 51 | 699 |
| | 16 | 0.004 | 84 | 3.6 | A | A | A | 53 | 673 |
| | 17 | 0.004 | 83 | 3.1 | A | A | A | 50 | 711 |

Note)

① Ni + Si concentration of compounds A, B and C mass %

② Ration for horizontal length x to vertical length y of the grain

TABLE 2

| | | Alloy element | | | Manufacturing Condition | | | | | | | |
|---|---|---|---|---|---|---|---|---|---|---|---|---|
| | | Mass % | | | Reheating | | Hot rolling | | | Aging heat treatment | | |
| | | | | | | | | End | Cooling | | | |
| Classi-fication | No | No | Si | Selected Element | Temp. ° C. | Time hr | Time Sec. | Temp ° C. | Speed ° C./Sec | Temp. ° C. | Time hr | a/(b + c) |
| Example No. 3 | 21 | 2.5 | 0.65 | 0.08Mg | 845 | 2 | 350 | 720 | 30 | 425 | 4 | 0.002 |
| | 22 | 2.7 | 0.65 | 0.12Mg | 890 | 3 | 350 | 740 | 80 | 460 | 2.5 | 0.001 |
| | 23 | 2.9 | 0.65 | 0.15Mg | 900 | 2 | 380 | 750 | 40 | 480 | 3 | 0.003 |
| | 24 | 3.3 | 0.65 | 0.08Mg + 0.2Zn | 925 | 2 | 370 | 730 | 50 | 420 | 4 | 0.004 |
| | 25 | 2.4 | 0.43 | 0.12Mg + 0.3Zn | 900 | 2 | 300 | 720 | 30 | 455 | 2 | 0.002 |
| | 26 | 2.7 | 1.08 | 0.15Mg + 0.1Zn | 915 | 4 | 280 | 780 | 90 | 420 | 3 | 0.005 |
| | 27 | 3.3 | 0.65 | 0.08Mg + 0.1Sn | 890 | 2 | 290 | 720 | 100 | 435 | 2.5 | 0.005 |
| | 28 | 2.6 | 0.65 | 0.08Mg + 0.2Sn | 880 | 4 | 310 | 700 | 90 | 490 | 2 | 0.002 |
| | 29 | 2.7 | 0.65 | 0.08Mg | 890 | 2 | 180 | 720 | 90 | 450 | 2.5 | 0.005 |
| | 30 | 3.0 | 0.65 | 0.12Mg | 900 | 3 | 280 | 790 | 70 | 420 | 3 | 0.002 |
| Comp. Emample No. 1 | 31 | 3.0 | 0.65 | — | 800 | 2 | 300 | 650 | 70 | 410 | 1.5 | 0.012 |
| | 32 | 3.0 | 0.65 | 0.1Mg | 850 | 1 | 330 | 680 | 50 | 425 | 2 | 0.015 |
| | 33 | 3.0 | 0.65 | — | 900 | 2 | 50 | 810 | 90 | 480 | 2 | 0.004 |
| | 34 | 3.0 | 0.65 | 0.15Mg | 880 | 4 | 300 | 550 | 120 | 450 | 2 | 0.007 |
| | 35 | 3.0 | 0.65 | — | 850 | 3 | 280 | 700 | 10 | 425 | 4 | 0.008 |
| | 36 | 3.0 | 0.65 | 0.5Zn | 900 | 3 | 400 | 690 | 70 | 600 | 3 | 0.007 |
| | 37 | 3.0 | 0.65 | — | 850 | 2 | 280 | 710 | 60 | 475 | 6 | 0.006 |

| | | | ① | | Characteristics | | | | |
|---|---|---|---|---|---|---|---|---|---|
| Classi-fication | No | b/c | Ni + Si in the compound | ② x/y | Plating property | Press form-ability | Heat Resis-tance | Conduc-ttivity | Tensile StrengTh |
| Example No. 3 | 21 | 0.01 | 92 | 3.1 | A | A | A | 53 | 690 |
| | 22 | 0.008 | 97 | 3 | A | A | A | 52 | 692 |
| | 23 | 0.009 | 95 | 2.8 | A | A | A | 55 | 702 |
| | 24 | 0.011 | 92 | 2.8 | A | A | A | 53 | 705 |
| | 25 | 0.005 | 92 | 2.9 | A | A | A | 56 | 658 |
| | 26 | 0.006 | 92 | 3.3 | A | A | A | 52 | 705 |
| | 27 | 0.012 | 90 | 3.1 | A | A | A | 53 | 700 |

TABLE 2-continued

| | | | | | | | | | |
|---|---|---|---|---|---|---|---|---|---|
| | 28 | 0.017 | 82 | 3.4 | A | A | A | 52 | 692 |
| | 29 | 0.006 | 91 | 2.9 | A | A | A | 50 | 723 |
| | 30 | 0.016 | 92 | 3.3 | A | A | A | 53 | 703 |
| Comp. | 31 | 0.071 | 53 | 3.4 | B | B | A | 42 | 625 |
| Emample | 32 | 0.088 | 81 | 0.8 | C | C | A | 48 | 610 |
| No. 1 | 33 | 0.0008 | 88 | 3.4 | A | C | A | 55 | 660 |
| | 34 | 0.0007 | 84 | 3.1 | A | C | A | 51 | 699 |
| | 35 | 0.0006 | 81 | 2.9 | A | C | A | 48 | 730 |
| | 36 | 0.12 | 86 | 1.5 | A | B | A | 68 | 508 |
| | 37 | 0.15 | 76 | 1.8 | A | B | A | 54 | 520 |

Note)

① Ni + Si concentration of compounds A, B and C mass %

② Ration for horizontal length x to vertical length y of the grain

As apparent from Tables 1 and 2, the copper alloy strip materials (No. 1 to No. 30) according to the present invention exhibit excellent plating property, press formability and heat resistance. Also, they show good conductivity and tensile strength.

The [a/(b+c)] values of Nos. 31 and 32 of comparative example 1 are out of the scope of the present invention, thereby exhibiting low press formability, strength and plating property. The [x/y] value of No. 32 was smaller than the scope of the present invention, No. 32 exhibits very low press formability. Contrarily, the [b/c] values of Nos. 33 to 35 are smaller than the scope of the present invention, they exhibit low press formability. The [b/c] values of Nos. 36 and 37 were larger than the scope of the present invention, they exhibited low strength. Further, the [x/y] values thereof were smaller than the scope of the present invention, they exhibit low press formability.

The copper alloy strip materials (Nos. 1 to 30) were additionally evaluated with respect to stress relaxation resistance property and bending workability required for electrical/electronic equipment. As a result, it was found that they had the stress relaxation resistance property and bending workability acceptable in practical use.

Example 4

Copper alloys (No. 38 to No. 41) having compositions listed in Table 3 comprising Ni, Si, Co, and the remaining component formed of Cu and unavoidable impurities were subjected to treatments similar to those of example 1 except conditions shown in Table 1, thereby obtaining test materials. The test materials were evaluated similarly to example 1.

TABLE 3

| | | Alloy element | | | Manufacturing Condition | | | | | | | |
|---|---|---|---|---|---|---|---|---|---|---|---|---|
| | | Mass % | | | | | Hot rolling | | | Aging heat | | |
| | | | | Selected | Reheating | | | End | Cooling | treatment | | |
| Classi-fication | No | No | Si | Element Co | Temp. ° C. | Time hr | Time Sec. | Temp ° C. | Speed ° C./Sec | Temp. ° C. | Time hr | a/(b + c) |
| Example | 38 | 0.5 | 0.2 | 0.37 | 870 | 2 | 250 | 710 | 70 | 525 | 2.5 | 0.002 |
| No. 4 | 39 | 1.1 | 0.44 | 0.81 | 900 | 2 | 310 | 750 | 80 | 550 | 4 | 0.001 |
| | 40 | 1.5 | 0.6 | 1.1 | 950 | 3 | 330 | 780 | 80 | 526 | 4.5 | 0.002 |
| | 41 | 2.1 | 0.85 | 1.54 | 980 | 3 | 380 | 810 | 90 | 550 | 3 | 0.002 |

| | | | ① | | Characteristics | | | | |
|---|---|---|---|---|---|---|---|---|---|
| Classi-fication | No | b/c | Ni + Si in the compound | ② x/y | Plating property | Press form-ability | Heat Resis-tance | Conduc-ttivity | Tensile StrengTh |
| Example | 38 | 0.05 | 80 | 3.7 | A | A | A | 60 | 676 |
| No. 4 | 39 | 0.04 | 75 | 4.1 | A | A | A | 56 | 690 |
| | 40 | 0.06 | 55 | 3.9 | A | A | A | 53 | 738 |
| | 41 | 0.03 | 65 | 4.6 | A | A | A | 49 | 755 |

Note)

① Ni + Si concentration of compounds A, B and C mass %

② Ration for horizontal length x to vertical length y of the grain

As apparent from Table 3, the copper alloy strip materials (No. 38 to No. 41) according to the present invention exhibit excellent plating property, press formability and heat resistance, similar to the copper alloy strip materials of examples 1 to 3. Also, they have good conductivity and tensile strength.

INDUSTRIAL APPLICABILITY

As set forth in the foregoing, the copper alloy strip material is suitable for electrical/electronic equipment such as lead frames, connectors, terminals, relays, switches and the like.

While the present invention has been described with reference to the particular illustrative embodiments, it is not to be restricted by the embodiments and only by the appended claims. Those skilled in the art may change or modify the embodiments within the scope of the present invention.

This application claims the priority of Japanese patent application No. 2006-246961, filed Dec. 12, 2006 and the priority of Japanese patent application No. 2007-236003, filed Sep. 11, 2007, the disclosure of which is expressly incorporated by reference herein.

The invention claimed is:

1. A copper alloy strip material for electrical/electronic equipment, comprising:

a copper alloy containing 2.0 to 5.0 mass % Ni, 0.43 to 1.5 mass % Si, and a remaining component formed of Cu and an unavoidable impurity, wherein three types of intermetallic compounds A, B, and C comprising Ni and Si in a total amount of 50 mass % or more are contained, said intermetallic compound A having a compound diameter of 0.3 μm to 2 μm, said intermetallic compound B having a compound diameter of 0.05 μm to less than 0.3 μm, said intermetallic compound C having a compound diameter of more than 0.001 μm to less than 0.05 μm, a crystal grain of the copper alloy strip material has a sectional shape taken along a plane perpendicular to a rolling direction thereof, said sectional shape having a horizontal length X (μm) and a vertical length y (μm) so that an expression [$x/y \geqq 2$] is satisfied, and said intermetallic compound A has a dispersion density a, said intermetallic compound B has a dispersion density b and said intermetallic compound C has a dispersion density c so that an expression [$a/(b+c) \leqq 0.010$] and an expression [$0.001 \leqq (b/c) \leqq 0.10$] are satisfied.

2. The copper alloy strip material for electrical/electronic equipment according to claim 1, further comprising at least one selected from the group consisting of Al, As, Hf, Zr, Cr, Ti, C, Co, Fe, P, In, Sb, Mn, Ta, V, Sn, Zn, and Mg in a total amount of 0.005 to 1.5 mass %.

3. A method for manufacturing a copper alloy strip material for electrical/electronic equipment, comprising the steps of:

reheating a cast ingot of a copper alloy comprising 2.0 to 5.0 mass % Ni, 0.43 to 1.5 mass % Si, and a remaining component formed of Cu and an unavoidable impurity at a temperature in a range between 850° C. and 950° C. for two hours to ten hours;

hot rolling the cast ingot of the copper alloy for 100 seconds to 500 seconds to obtain a copper alloy strip material;

rapidly cooling the copper alloy strip material to a temperature in a range between 600° C. and 800° C.; and performing an aging heat treatment on the copper alloy strip material at a temperature in a range between 400° C. and 550° C. for one hour to four hours, wherein said copper alloy strip material contains three types of intermetallic compounds A, B, and C comprising Ni and Si in a total amount of 50 mass % or more, said intermetallic compound A having a compound diameter of 0.3 μm to 2 μm, said intermetallic compound B having a compound diameter of 0.05 μm to less than 0.3 μm, said intermetallic compound C having a compound diameter of more than 0.001 μm to less than 0.05 μm, a crystal grain of the copper alloy strip material has a sectional shape taken along a plane perpendicular to a rolling direction thereof, said sectional shape having a horizontal length X (μm) and a vertical length y (μm) so that an expression [$x/y \geqq 2$] is satisfied, and said intermetallic compound A has a dispersion density a, said intermetallic compound B has a dispersion density b and said intermetallic compound C has a dispersion density c so that an expression [$a/(b+c) \leqq 0.010$] and an expression [$0.001 \leqq (b/c) \leqq 0.10$] are satisfied.

4. The method for manufacturing a copper alloy strip material for electrical/electronic equipment according to claim 3, wherein said cast ingot of the copper alloy further contains at least one selected from the group consisting of Al, As, Hf, Zr, Cr, Ti, C, Co, Fe, P, In, Sb, Mn, Ta, V, Sn, Zn, and Mg in a total amount of 0.005 to 1.5 mass.

* * * * *